US009456692B2

(12) United States Patent
Tibbe et al.

(10) Patent No.: US 9,456,692 B2
(45) Date of Patent: Oct. 4, 2016

(54) MULTI-PIECE SHELF BRACKETS AND METHODS OF ASSEMBLING THE SAME

(71) Applicant: Knape & Vogt Manufacturing Company, Grand Rapids, MI (US)

(72) Inventors: Jeffrey S. Tibbe, Coopersville, MI (US); Daniel L. Krueger, Rockford, MI (US)

(73) Assignee: Knape & Vogt Manufacturing Company, Grand Rapids, MI (US)

( * ) Notice: Subject to any disclaimer, the term of this patent is extended or adjusted under 35 U.S.C. 154(b) by 70 days.

(21) Appl. No.: 14/510,923

(22) Filed: Oct. 9, 2014

(65) Prior Publication Data

US 2016/0100685 A1 Apr. 14, 2016

(51) Int. Cl.
*A47B 96/06* (2006.01)

(52) U.S. Cl.
CPC ..... *A47B 96/061* (2013.01); *A47B 96/06* (2013.01)

(58) Field of Classification Search
USPC ..... 248/235, 239, 250; 211/134, 153, 90.01
See application file for complete search history.

(56) References Cited

U.S. PATENT DOCUMENTS

| | | | | |
|---|---|---|---|---|
| 1,254,170 | A | 1/1918 | Taussig | |
| 1,842,786 | A | 1/1932 | Kirsch | |
| 1,913,988 | A | 6/1933 | Keefe | |
| 1,939,408 | A | 12/1933 | Parker | |
| 2,236,044 | A | 3/1941 | Vanderveld et al. | |
| 3,242,886 | A | 3/1966 | Chesley | |
| 3,368,227 | A * | 2/1968 | Underdown, Jr. | F16B 12/58 248/243 |
| 3,604,670 | A * | 9/1971 | Reeves | A47B 96/061 108/108 |
| 3,674,230 | A | 7/1972 | Propst | |
| 3,712,698 | A | 1/1973 | Propst et al. | |
| 3,759,297 | A | 9/1973 | Anderson et al. | |
| 3,966,158 | A | 6/1976 | Boundy | |
| 4,146,140 | A | 3/1979 | Suter et al. | |
| 4,154,419 | A | 5/1979 | Breidenbach | |
| 4,592,286 | A | 6/1986 | Trubiano | |
| 4,671,481 | A * | 6/1987 | Beard | A47B 57/42 248/222.13 |
| 4,854,535 | A * | 8/1989 | Winter | A47B 57/42 108/108 |
| 4,872,567 | A | 10/1989 | Bustos | |
| 4,898,354 | A | 2/1990 | Whittington et al. | |
| 5,205,524 | A * | 4/1993 | Cohen | A47B 57/06 211/103 |
| 5,354,025 | A * | 10/1994 | McCaffrey | A47B 96/06 108/156 |
| 5,484,068 | A | 1/1996 | Huang | |
| 5,535,972 | A | 7/1996 | Fallago | |
| 5,975,318 | A | 11/1999 | Jay | |
| 6,168,032 | B1 | 1/2001 | Merl | |
| 6,481,678 | B1 | 11/2002 | Chong | |
| 6,773,080 | B2 | 8/2004 | Chen et al. | |
| 6,962,116 | B2 | 11/2005 | Bienick et al. | |
| 6,966,267 | B2 | 11/2005 | Bienick | |
| 7,111,813 | B2 | 9/2006 | Lin | |
| 7,311,211 | B2 | 12/2007 | Chung | |
| 7,575,212 | B1 | 8/2009 | Langelius | |
| 8,152,119 | B2 | 4/2012 | Pfund et al. | |
| 8,348,210 | B1 * | 1/2013 | Lee | A47F 5/103 248/220.31 |
| 2002/0179797 | A1 * | 12/2002 | Cunha | A47B 57/42 248/343 |
| 2004/0182804 | A1 | 9/2004 | Harper | |

* cited by examiner

*Primary Examiner* — Alfred J Wujciak
(74) *Attorney, Agent, or Firm* — Cook Alex Ltd.

(57) ABSTRACT

This disclosure provides a multi-piece shelf bracket including a support arm that receives a connector having a support portion and at least one hook portion, and a method of assembling the multi-piece shelf bracket.

28 Claims, 6 Drawing Sheets

MULTI-PIECE SHELF BRACKETS AND METHODS OF ASSEMBLING THE SAME

FIELD OF THE DISCLOSURE

This disclosure generally relates to shelf brackets for use with standards that are configured for attachment to vertical surfaces and to provide support for a shelf. More particularly, it relates to shelf brackets that are of a multi-piece construction and methods of assembling the same.

BACKGROUND

Shelf brackets tend to be used to support shelves in a generally horizontal orientation extending outward from vertical surfaces. Shelf brackets commonly are formed from a single material and in a single piece, such as from a stamped and bent steel sheet. Such shelf brackets are configured to have a support arm, on which a shelf will rest, and an integrally formed connector. The integrally formed connector of a conventional shelf support bracket typically includes a plurality of vertically aligned and spaced apart hook portions that are insertable into respective vertically aligned and spaced apart slots of a conventional standard. A standard may be mounted to a vertical surface, such as a wall, a backing panel or the like, by fixing members, such as screws or other suitable fasteners. Once the hook portions are inserted into the slots of the standard, the connector is moved downward to have the hook portions engage and be supported by the standard.

To provide sufficient strength, prior art shelf brackets typically are constructed of a single strong and rugged material, such as steel. By comparison, materials that might otherwise be used for more architectural or stylistic purposes, such as die cast aluminum, zinc, molded plastics, ceramics or wood, generally do not permit the formation of hook portions having adequate strength to permit even modest load capacity. In addition, shelf brackets constructed solely of such alternative stylish materials would tend not to bend when over loaded, but rather would tend to have a failure mode that would be catastrophic, because the hook portions would tend to fracture without fore warning and in a manner that would result in a complete collapse of the shelf bracket, risking injury to persons and to possessions placed on or below the shelf.

SUMMARY

The example shelf brackets of the present disclosure, and methods of assembling the same, permit use of a variety of materials, styles and methods of construction of support arms, which are used in combination with connectors that may be constructed with different materials. Together the support arms and connectors provide enhanced loading capabilities, and a safer indication of excessive loading. When a shelf is placed on a shelf bracket of consistent with the present disclosure, a portion of the support arm generally is placed in compression between a connector that is received by and extends within the support arm and the overlying shelf that rests on the support arm. The ability to utilize a greater variety of materials in designing and constructing shelf brackets is highly advantageous and would permit more diverse, creative and artistic shelf bracket designs. Depending on the selection of materials, this also may yield shelf brackets of thinner construction or made of lighter weight materials, thereby reducing the weight, which may affect the shipping and material costs.

In addition, each support arm may be constructed to receive one or more connectors having at least one hook portion. Each support arm further may be constructed to receive a locking element to ensure that at least a portion of the one or more connectors is secured within the support arm. The locking element also may be inserted into the support arm in an orientation in which it may be partially or fully hidden from view when a shelf is installed on the shelf bracket. Hence, the present disclosure addresses shortcomings in prior art shelf brackets, while providing for enhanced aesthetic designs and structures.

In a first aspect, a multi-piece shelf bracket is provided with the multi-piece shelf bracket including a support arm having a first opening at a proximal end and a cavity that extends forward longitudinally into the support arm from the first opening, at least one connector having at least one hook portion and a support portion that extends longitudinally forward from the at least one hook portion, wherein the support portion is inserted through the first opening and into the cavity in the support arm, with the support portion including an opening that extends laterally, the support arm having a second opening located forward of the proximal end and being aligned with the opening in the support portion of the connector, and at least one locking member received by the second opening of the support arm and the opening in the support portion of the connector.

In another aspect, a method of assembling a multi-piece shelf bracket is provided with the method comprising the steps of providing a support arm having a first opening at a proximal end, a cavity that extends forward longitudinally into the support arm from the first opening, and a second opening located forward of the proximal end, providing at least one connector having at least one hook portion and a support portion that extends longitudinally forward from the at least one hook portion, wherein the support portion includes an opening that extends laterally. The method further includes inserting the support portion at least partially into the cavity in the support arm while the at least one hook portion is at an acute angle to the proximal end of the support arm, moving the connector until the at least one hook portion is parallel to the proximal end of the support arm, and inserting at least one locking member into the second opening of the support arm and the opening in the support portion of the connector.

It is to be understood that both the foregoing general description and the following detailed description are exemplary and provided for purposes of explanation only, and are not restrictive of the disclosure, as claimed. Further features and objects of the present disclosure will become more fully apparent in the following description of an example embodiment and from the appended claims.

BRIEF DESCRIPTION OF THE DRAWINGS

In describing the example multi-piece shelf brackets disclosed herein, reference is made to the accompanying drawings wherein like parts have like reference numerals, and wherein.

It should be understood that the drawings are not to scale and that actual embodiments may differ. It also should be understood that the claims are not limited to the particular examples illustrated, but rather cover various configurations of multi-piece shelf brackets and shelf systems using the same.

DETAILED DESCRIPTION

Although the following discloses examples of multi-piece shelf brackets and methods of assembly thereof, persons of ordinary skill in the art will appreciate that the teachings of this disclosure are in no way limited to the example embodiments. On the contrary, it is contemplated that the teachings of this disclosure may be implemented in alternative configurations and environments. In addition, although the examples described herein are shown in conjunction with a particular configuration of standards and shelves, those having ordinary skill in the art will readily recognize that the teachings of the disclosure herein may be used in alternative vertical mountings, whether to a standard, panel, wall or the like, and may be used with alternative shelf constructions or to support other items thereon, if configured accordingly.

Figure 1:
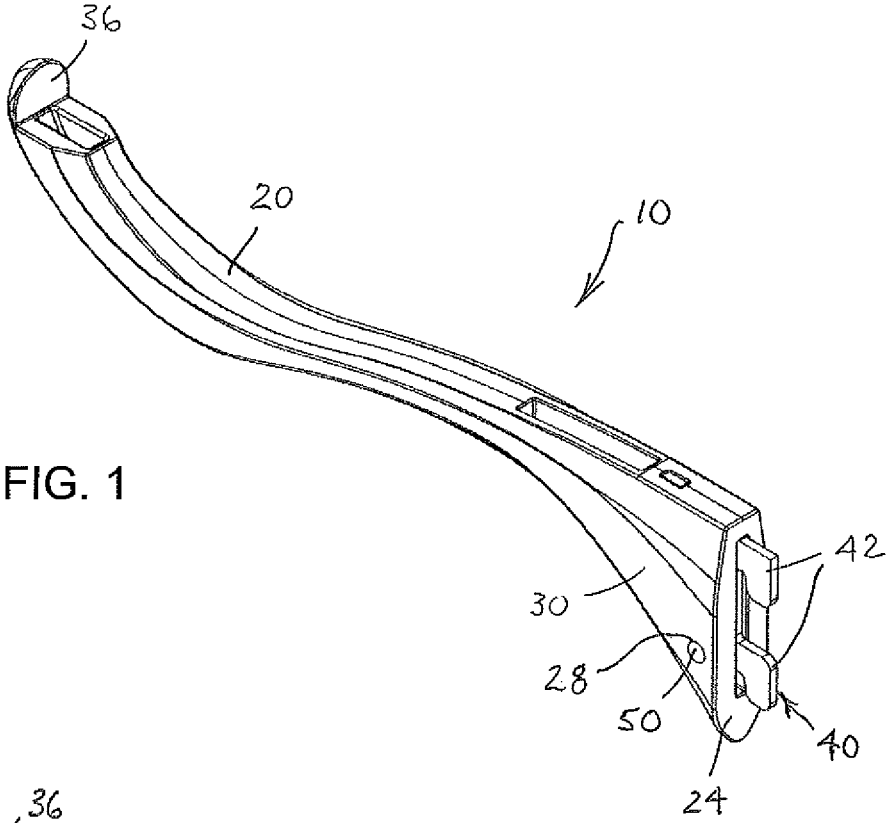
FIG. 1 is a rear perspective view of a first example multi-piece shelf bracket for use with a vertical standard having a support arm constructed of a first material that is used in combination with a connector constructed of a second material and having at least one hook portion.
Figure 2:
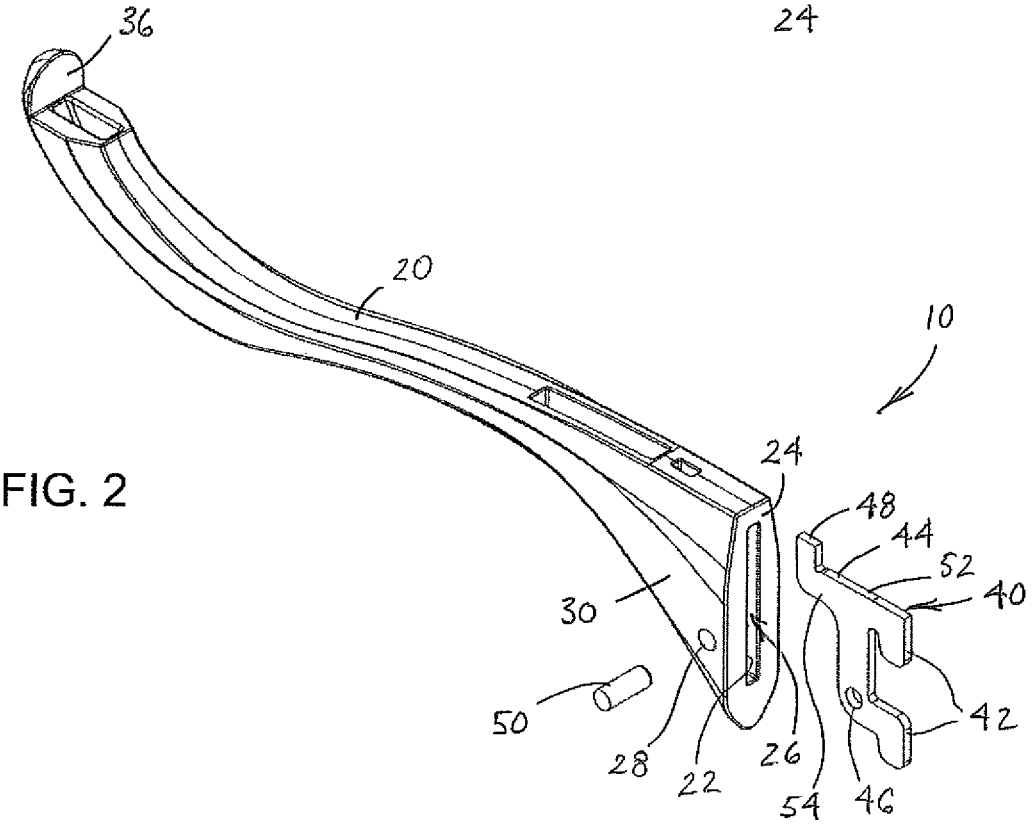
FIG. 2 is a rear perspective exploded view of the multi-piece shelf bracket of FIG. 1.
Figure 3:
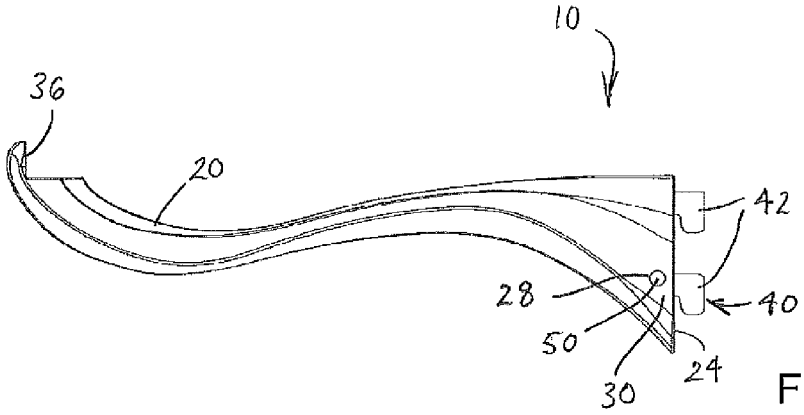
FIG. 3 is a side plan view of the multi-piece shelf bracket of FIG. 1.
Figure 4:
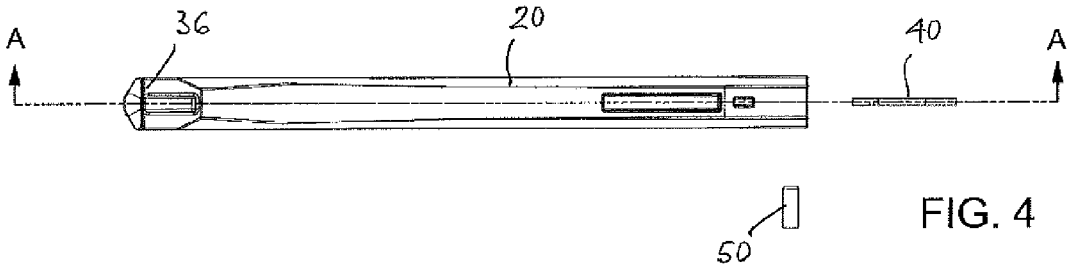
FIG. 4 is a top perspective exploded view of the multi-piece shelf bracket of FIG. 1.
Figure 5:
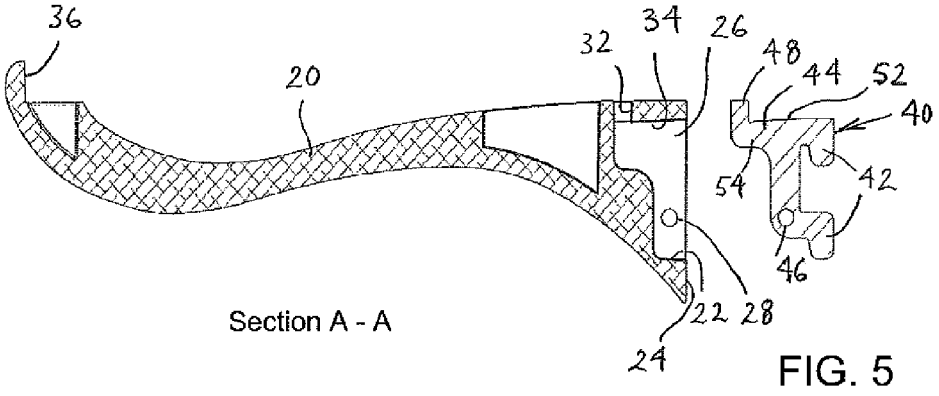
FIG. 5 is a cross-section view of the support arm and connector of the multi-piece shelf bracket of FIG. 1.
Figure 6:
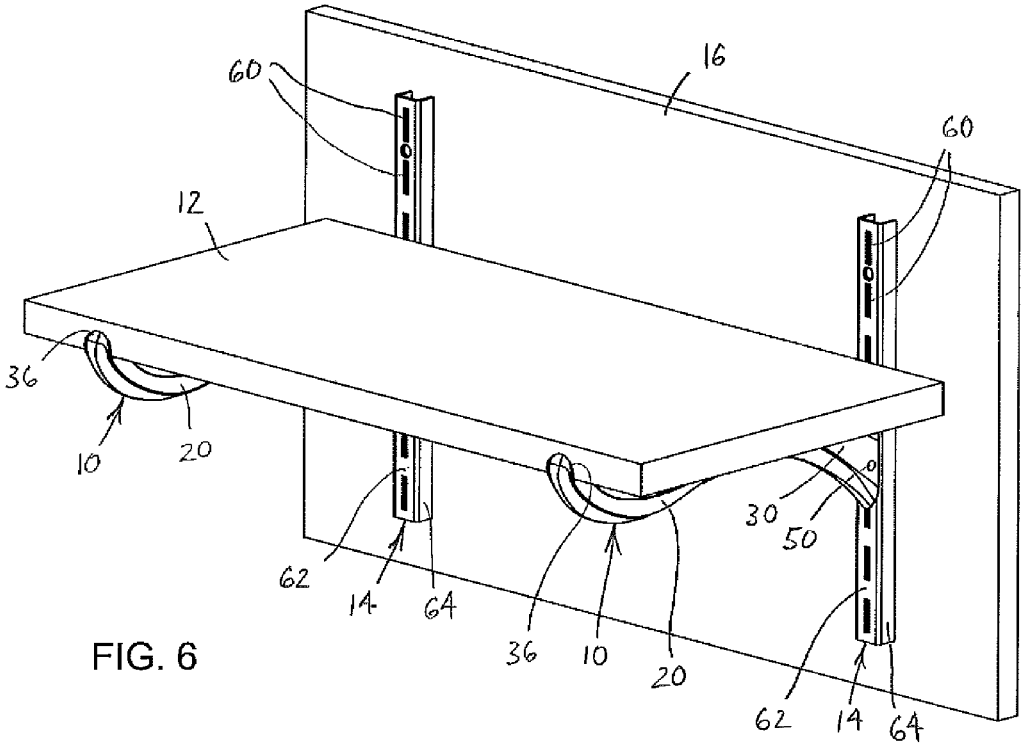
FIG. 6 is a top view of a pair of multi-piece shelf brackets of FIG. 1 connected to vertical standards having a single row of spaced apart vertical slots and supporting a shelf atop the support arms.
Figure 7:
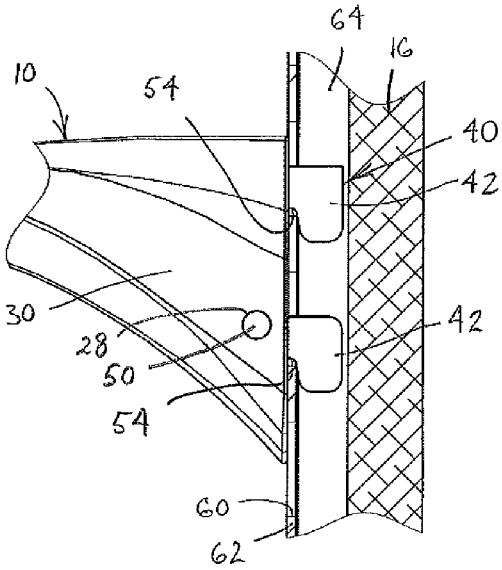
FIG. 7 is a side view of a rear portion of a multi-piece shelf bracket of FIG. 1 connected to the vertical standard of FIG. 6, with the vertical standard shown in cross-section.

Referring to FIGS. 1-7, it will be appreciated that a first example multi-piece shelf bracket 10 is provided and is shown for use in a pair to support a shelf 12, with the pair of multi-piece shelf brackets 10 being assembled to a corresponding pair of standards 14 that are mounted in a vertical orientation on a section of wall 16. The multi-piece shelf bracket 10 includes a support arm 20 having a first opening 22 at a proximal end 24 and a cavity 26 that extends forward longitudinally into the support arm 20 from the first opening 22. The multi-piece shelf bracket 10 further includes at least one connector 40 having at least one hook portion 42 and a support portion 44 that extends longitudinally forward from the hook portion 42. It will be appreciated that one or more hook portion 42 may be used, and the present example happens to show two spaced apart, vertically aligned hook portions 42, although depending on the load capacity and other requirements, one, two or more hook portions could be accommodated in a slotted standard.

When assembled, the support portion 44 is inserted through the first opening 22 and into the cavity 26 in the support arm 20. The support portion 44 also includes an opening 46 that extends laterally. The support arm 20 has a second opening 28 that extends through a wall 30 of the support arm 20 and is located forward of the proximal end 24. In this example, the second opening 28 is through an upward extending wall 30. The second opening 28 in the support arm 20 also is aligned with the opening 46 in the support portion 44 of the connector 40 when the connector 40 has been received in the support arm 20, such that at least one locking member 50 may be received by the second opening 28 of the support arm 20 and by the opening 46 in the support portion 44 of the connector 40 to lock the connector 40 to the support arm 20.

The locking element 50 of this example is in the configuration of a snugly fitting pin, such as a press-fit pin, although it will be appreciated that alternative structures may be used to retain a locking element, such as threads or use of an alternative interference fit or the like. Moreover, to help conceal the locking element 50, it may be configured to be flush with or recessed from the outer surface of a wall 30 of the support arm 20 when inserted into the second opening 28 of the support arm 20 and the opening 46 of the connector 40. Additionally, the second opening 28 may extend through only one wall 30 of the support arm 20, so as not to be visible from at least three surfaces of the support arm 20.

In the present first example, the cavity 26 may further include a stop surface 32 located forward of the opening at the proximal end 24 of the support arm 20. In turn, the support portion 44 of the connector 40 may include a lug 48 that is located forward of the at least one hook portion 42, and when the support portion 44 of the connector 40 is received in the cavity 26, the lug 48 is located forward of and engages the stop surface 32. To insert the support portion 44, the lug 48 must be partially inserted into the cavity 26 in the support arm 20 while the at least one hook portion 42 is at an angle other than parallel, or an acute angle, relative to the proximal end 24 of the support arm 20. This permits the lug 48 to reach in and pass by the stop surface 32. The support portion 44 then is moved until the at least one hook portion 42 is parallel to the proximal end 24 of the support arm 20, prior to insertion of the at least one locking member 50 into the second opening 28 of the support arm 20 and the opening 46 in the support portion 44 of the connector 40. A seating portion 34 of the support arm 20 is seated on a seat 52 of the support portion 44 after the connector 40 is moved into position, such as by being rotated, for insertion of the locking member 50 through the second opening 28 in the support arm 20 and into the opening 46 in the connector 40. The support arm 20 also may include a shelf stop 36 at its distal end to help retain a shelf 12 that is supported by the multi-piece shelf bracket 10 by preventing it from easily shifting forward and potentially falling from the multi-piece shelf bracket 10. It will be appreciated that the shelf stop could be located along a top surface of the support arm 20 and engage a recess in the bottom surface of the overlying shelf, so as to be concealed.

With this advantageous construction, the support arms 20 may be constructed of a first material that may be one of any variety of materials including more traditional structural materials, such as durable cast metals and plastics, but importantly also may be constructed of non-traditional shelf bracket materials that may permit a greater range of aesthetic design but that would otherwise be thought to be somewhat weak or brittle, such as die cast aluminum, zinc, molded plastics, ceramics, wood or the like. The connectors 40 should be considerably stronger and more durable, and therefore, may be constructed of a second material that would be more typically used in an integral shelf bracket construction, such as being made of a formed metal sheet or plate material, or of a high strength plastic, and may have one or more hook portion depending on the strength of the material selected for the connectors and the desired load capacity. With more options for material selection, there may be savings by being able to make portions of shelf brackets of lower weight or lower cost materials, which also could affect shipping and material costs.

As shown, if the connectors 40 have two or more hook portions 42, they may be vertically aligned, and configured for insertion into spaced apart slots 60 in the vertically disposed standard 14. Each standard 14 includes a front wall 62 and two side walls 64 extending rearwardly therefrom. The slots 60 are vertically aligned and spaced apart along the front wall 62. The side walls 64 are dimensioned to permit a hook portion 42 of the connector 40 to be inserted through a slot 60 and then lowered to a position where a horizontal extension 54 of the hook portion 42 from the support portion 44 engages and is supported by the front wall 62 of the standard 14 at the lower end of the slot 60. It will be appreciated by review of this disclosure and the second example herein, that a multi-piece shelf bracket in accordance with the present invention may include more than one connector and that the at least one hook portion may be configured to include a plurality of hook portions spaced apart horizontally or generally in a side-to-side orientation, as well as vertically. Moreover, the strong and non-brittle connectors provide for increased load capacity with selection of using at least one, or two or more hook portions, depending on the desired load capacity, while providing a safer failure mode if the at least one hook portion is overloaded. For instance, the connectors are likely to bend but not immediately fracture when overloaded, providing an opportunity for a user to take note of the overloaded condition of the shelf brackets and to take corrective action prior to a catastrophic fall of the shelf and shelf brackets.

It will be appreciated that the aforementioned structures and description set forth a method of assembling a multi-piece shelf bracket 10 that includes the steps of providing a support arm 20 having a first opening 22 at a proximal end 24, a cavity 26 that extends forward longitudinally into the support arm 20 from the first opening 22, and a second opening 28 located forward of the proximal end 24. The method further includes providing at least one connector 40 having at least one hook portion 42 and a support portion 44 that extends longitudinally forward from the hook portion 42, wherein the support portion 44 includes an opening 46 that extends laterally. The method also includes inserting the support portion 44 at least partially into the cavity 26 in the support arm 20 while the at least one hook portion 42 is at an acute angle to the proximal end 24 of the support arm 20, moving the connector 40 until the at least one hook portion 42 is parallel to the proximal end 24 of the support arm 10, and inserting at least one locking member 50 into the second opening 28 of the support arm 20 and the opening 46 in the support portion 44 of the connector 40.

The method of assembling a multi-piece shelf bracket 10 further includes a step of locating a lug 48 on the support portion 44 of the connector 40 forward of a stop surface 32 in the cavity 26 of the support arm 20, prior to moving the connector 40 until the at least one hook portion 42 is parallel to the proximal end 24 of the support arm 20. Thus, the support portion 44 is moved, such as by being rotated, until the at least one hook portion 42 is parallel to the proximal end 24 of the support arm 20, prior to insertion of the at least one locking member 50 into the second opening 28 of the support arm 20 and the opening 46 in the support portion 44 of the connector 40. This method permits a relatively easy assembly wherein the shapes or configurations of the support arms and connectors play integral roles in retaining a connector within a support arm, while placing a portion of the support arm largely in compression under an overlying shelf, thereby reducing the likelihood of fracturing a support arm that may be constructed of a less strong or more brittle material.

Figure 8:
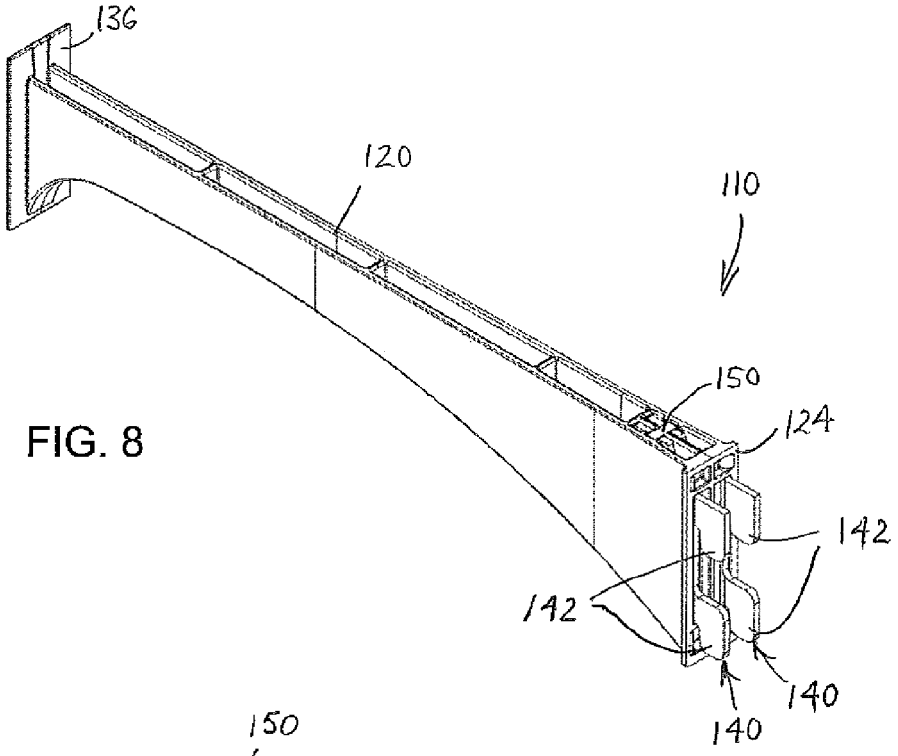
FIG. 8 is a rear perspective view of second example of a multi-piece shelf bracket for use with a vertical standard having a support arm constructed of a first material that is used in combination with a pair of connectors constructed of a second material, wherein each of the connectors has at least one hook portion.
Figure 9:
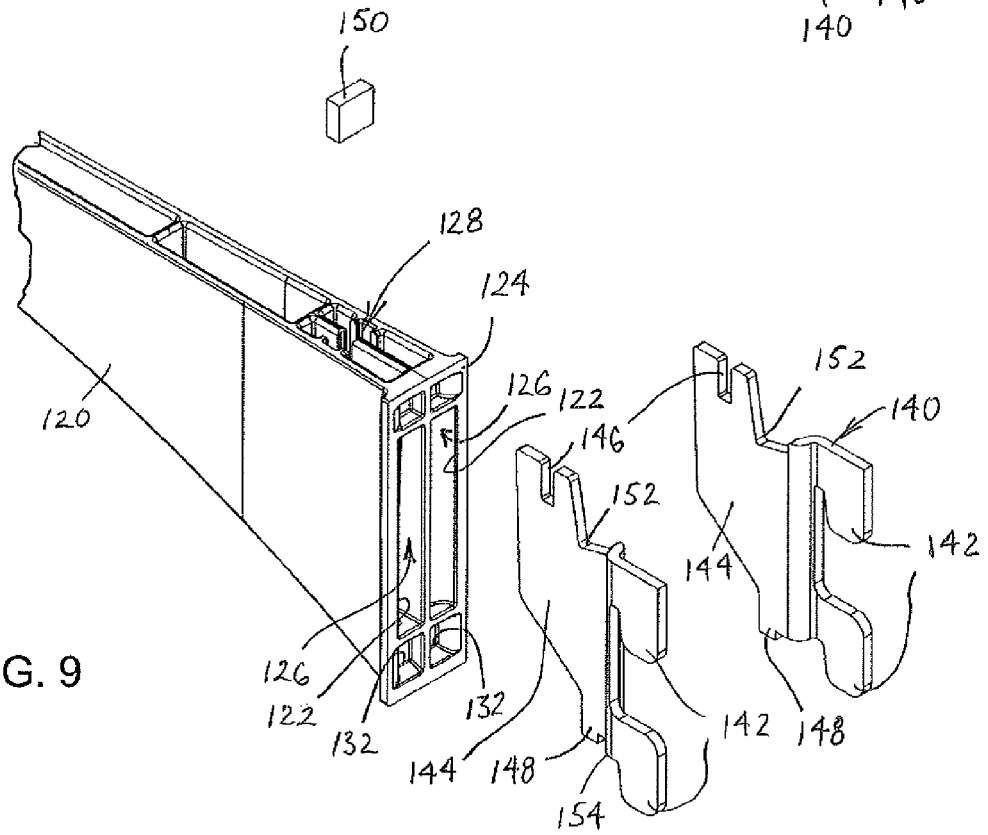
FIG. 9 is a rear perspective exploded view of a rear portion of the multi-piece shelf bracket of FIG. 8.
Figure 10:
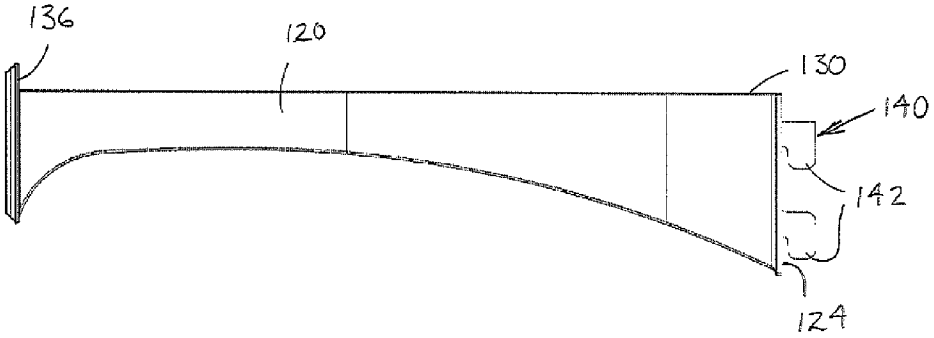
FIG. 10 is a side plan view of the multi-piece shelf bracket of FIG. 8.
Figure 11:
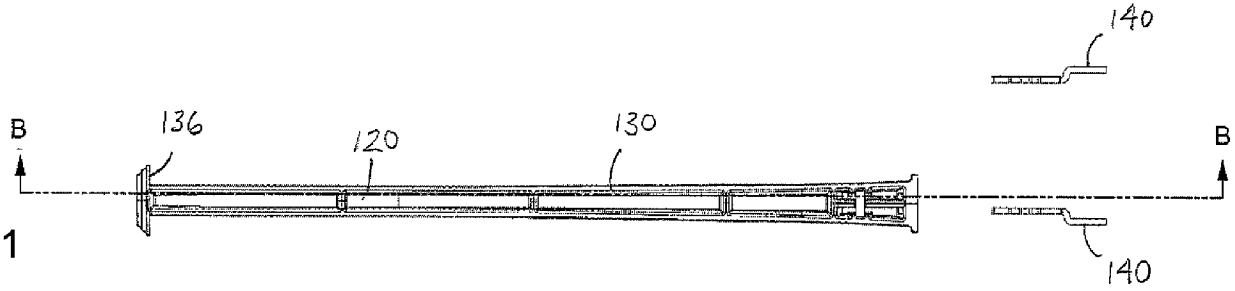
FIG. 11 is a top perspective exploded view of the multi-piece shelf bracket of FIG. 8.
Figure 12:
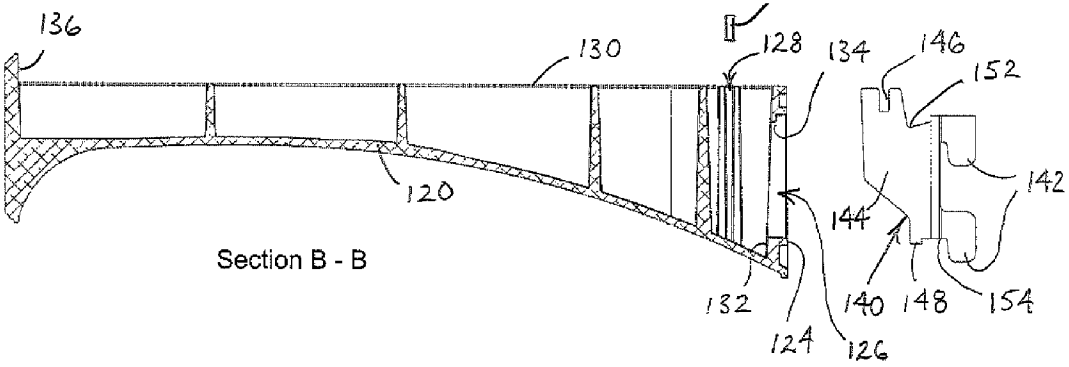
FIG. 12 is a cross-section view of the support arm and connector of the multi-piece shelf bracket of FIG. 8.
Figure 13:
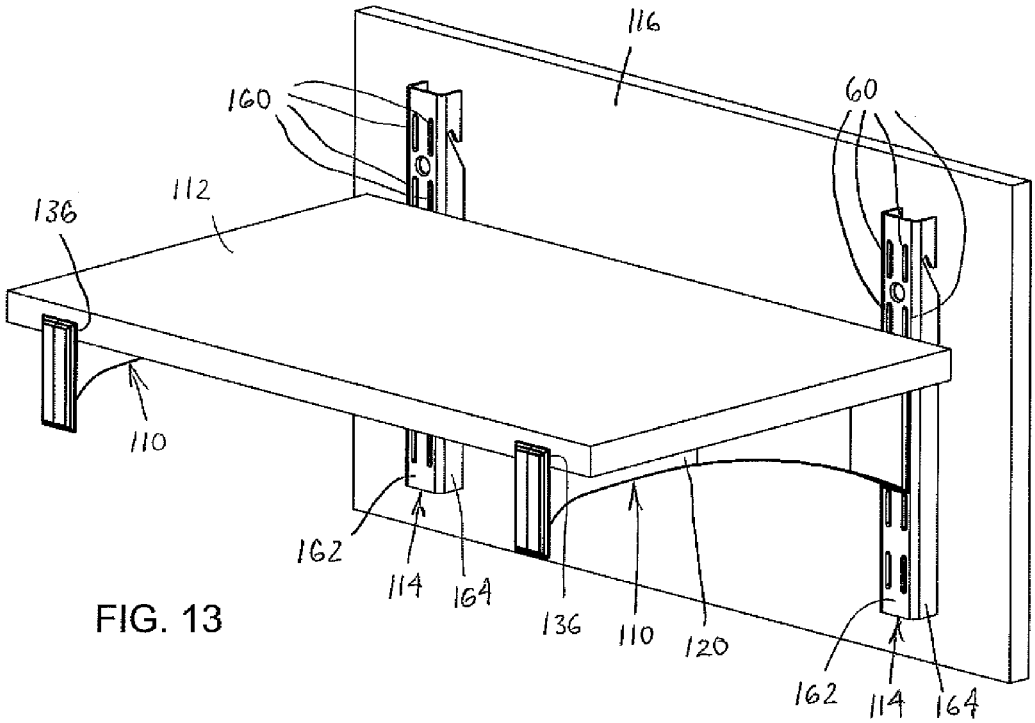
FIG. 13 is a top view of a pair of multi-piece shelf brackets of FIG. 8 connected to vertical standards having two rows of spaced apart vertical slots and supporting a shelf atop the support arms.
Figure 14:
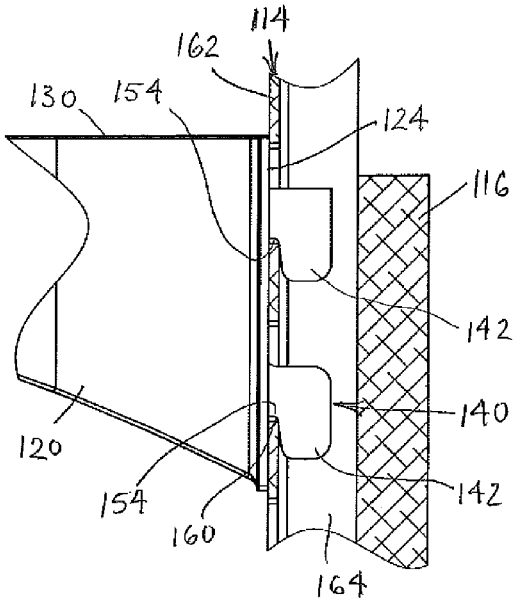
FIG. 14 is a side view of a rear of a multi-piece shelf bracket of FIG. 8 connected to the vertical standard of FIG. 13, with the vertical standard shown in cross-section.

Turning now to FIGS. 8-14, it will be appreciated that a second example multi-piece shelf bracket 110 is provided and is shown for use in a pair to support a shelf 112, with the pair of multi-piece shelf brackets 110 being assembled to a corresponding pair of standards 114 that are mounted in a vertical orientation on a section of wall 116. The multi-piece shelf bracket 110 includes a support arm 120 having a first opening 122 at a proximal end 124 and a cavity 126 that extends forward longitudinally into the support arm 120 from the first opening 122. The multi-piece shelf bracket 110 further includes at least one connector 140 having at least one hook portion 142 and a support portion 144 that extends longitudinally forward from the at least one hook portion 142. In this second example, the at least one connector 140 is depicted as a pair of connectors 140, with each configured to have a pair of spaced apart and vertically aligned hook portions 142. This configuration shares and benefits from the improved capacity and enhanced failure mode of the first example when compared to an attempt to make a shelf bracket from a single material that is not particularly strong and is subject to cracking.

When assembled, the support portion 144 is inserted through the first opening 122 and into the cavity 126 in the support arm 120. The support portion 144 also includes an opening 146 that extends laterally and upward. The support arm 120 has a second opening 128 that extends through a wall 130 of the support arm 120 and is located forward of the proximal end 124. In this example, the second opening 128 is through a wall 130 that provides a substantially horizontal surface of the support arm 120. The second opening 128 in the support arm 120 also is aligned with the opening 146 in the support portion 144 of the connector 140 when the connectors 140 have been received in a side by side configuration in the support arm 120, such that at least one locking member 150 may be received by the second opening 128 of the support arm 120 and by the opening 146 in the support portion 144 of the connector 140, so as to block the support portion 144 of each connector 140 from moving rearward, thereby locking each connector 140 to the support arm 120.

The locking element 150 of the second example is in the configuration of a key that is shaped as a block that is moved through the second opening 128 and into the openings 146 in the support portions 144 of the respective connectors 140. In this example, concealment of the locking element 150 is achieved by having the locking element 150 be at least flush with or recessed from the top surface of a wall 130 of the support arm 120 when inserted into the second opening 128 of the support arm 120 and the opening 146 of the connector 140. In this position, the locking element 150 will be covered by the overlying shelf 112 or any other structure that may be supported by the support arm 120. Additionally, the second opening 128 may extend through only one wall 130 of the support arm 120, so as not to be visible from at least three surfaces of the support arm 120 even prior to placing the shelf 112 on the support arm 120.

In the second example, the cavity 126 may further include a stop surface 132 located forward of the opening at the proximal end 124 of the support arm 120. In turn, the support portion 144 of the connector 140 may include a lug 148 that is located forward of the at least one hook portion 142 and when the support portion 144 of the connector 140 is received in the cavity 126, the lug 148 is located forward of and engages the stop surface 132. To insert the support portion 144, the lug 148 must be partially inserted into the cavity 126 in the support arm 120 while the at least one hook portion 142 is at an angle other than parallel, or an acute angle, relative to the proximal end 124 of the support arm 120. This permits the lug 148 to reach in and pass by the stop surface 132. The support portion 144 then is moved until the at least one hook portion 142 is parallel to the proximal end 124 of the support arm 120 and the lug 148 engages the stop surface 132. This position is achieved prior to insertion of the at least one locking member 150 into the second opening 128 of the support arm 120 and the opening 146 in the support portion 144 of the connector 140. A seating portion 134 of the support arm 120 is seated on a seat 152 of the support portion 144 after the connector 140 is moved, such as by being rotated, into position for insertion of the locking member 150 through the second opening 128 in the support arm 120 and into the opening 146 in the connector 140. As with the first example, the support arm 120 of the second example also may include a shelf stop 136, such as at a distal end or in an intermediate position in which it may be concealed within a recess in the underside of a shelf, to help retain a shelf 112 that is supported by the multi-piece shelf bracket 110. Such a shelf stop may be used to prevent a shelf from easily shifting forward and potentially falling from the multi-piece shelf bracket.

The description with respect to the first example regarding the ability to use a greater variety of materials in the construction of the components of the multi-piece shelf brackets and potential types of materials, also applies to the second example, depending on the materials, dimensions and load capacity chosen. Thus, with this further advantageous construction, the support arms 120 may be constructed of a first material that is different than and not as durable as the material of the connectors 140.

As shown, for added capacity two connectors 140 may be disposed in a side-by-side or laterally spaced configuration. Each connector 140 of the second example has at least one hook portion 142. In this example, the hook portions 142 of one connector 140 are vertically spaced apart and aligned, while pairs of hook portions 142 of the two respective connectors 140 are laterally spaced apart and aligned. Each hook portion 142 also is configured for insertion into a slot 160 in the vertically disposed standard 114, with the standard of this example providing a plurality of spaced apart slots 160. Each standard 114 includes a front wall 162 and two side walls 164 extending rearwardly therefrom. The slots 160 of this example are provided in two parallel rows and are vertically aligned and spaced apart along the front wall 162. The side walls 164 are dimensioned to permit the at least one hook portion 142 of each connector 140 to be inserted through a slot 160 and then lowered to a position where a horizontal extension 154 of the hook portion 142 from the support portion 144 engages and is supported by the front wall 162 of the standard 114 at the lower end of the slot 160. It will be appreciated by review of this disclosure and the second example herein, that a multi-piece shelf bracket in accordance with the present invention may include more than one connector, that each connector may include more than one hook portion, and that hook portions extending from a support arm may be spaced apart vertically and/or horizontally, such as in a generally side-to-side orientation.

It also will be appreciated that the aforementioned structures and description set forth a method of assembling a multi-piece shelf bracket 110 that includes the steps of providing a support arm 120 having a first opening 122 at a proximal end 124, a cavity 126 that extends forward longitudinally into the support arm 120 from the first opening 122, and a second opening 128 located forward of the proximal end 124. The method further includes providing at least one connector 140 having at least one hook portion 142 and a support portion 144 that extends longitudinally forward from the hook portion 142, wherein the support portion 144 includes an opening 146 that extends laterally. The method also includes inserting the support portion 144 at least partially into the cavity 126 in the support arm 120 while the at least one hook portion 142 is at an acute angle to the proximal end 124 of the support arm 120, moving the connector 140 until the at least one hook portion 142 is parallel to the proximal end 124 of the support arm 110, and inserting at least one locking member 150 into the second opening 128 of the support arm 120 and the opening 146 in the support portion 144 of the connector 140.

The method of assembling a multi-piece shelf bracket 110 further includes a step of locating a lug 148 on the support portion 144 of the connector 140 forward of a stop surface 132 in the cavity 126 of the support arm 120, prior to moving the connector 140 until the at least one hook portion 142 is parallel to the proximal end 124 of the support arm 120. Thus, the support portion 144 is moved, such as by being rotated, until the at least one hook portion 142 is parallel to the proximal end 124 of the support arm 120, prior to insertion of the at least one locking member 150 into the second opening 128 of the support arm 120 and the opening 146 in the support portion 144 of the connector 140. The method described with the second example similarly permits a relatively easy assembly wherein the shapes or configurations of the support arms and connectors play integral roles in retaining connectors within a support arm, while placing a portion of the support arm largely in compression under an overlying shelf, thereby reducing the likelihood of fracturing a support arm constructed of a less strong or more brittle material.

While the present disclosure shows and demonstrates example multi-piece shelf brackets and methods of assembling multi-piece shelf brackets, the examples are merely illustrative and are not to be considered limiting. It will be apparent to those of ordinary skill in the art that multi-piece shelf brackets in accordance with the present disclosure may be provided in various configurations, constructed of various materials and may be constructed to be installed in combination with various slotted vertical surfaces, without departing from the scope or spirit of the present disclosure. Any variety of suitable materials of construction, configurations, shapes and sizes for the components and methods of connecting the components within the scope of the claims may be utilized to meet the particular needs and requirements of an end user. Thus, although example embodiments and methods of assembly relating to multi-piece shelf brackets have been described herein, the scope of coverage of this patent is not limited to the examples illustrated. On the contrary, this patent covers all methods, apparatus and articles of manufacture fairly falling within the scope of the appended claims either literally or under the doctrine of equivalents.

What is claimed is:

1. A multi-piece shelf bracket comprising:

a support arm having a first opening at a proximal end and a cavity that extends forward longitudinally into the support arm from the first opening;

wherein the cavity includes a stop surface located forward of the first opening at the proximal end of the support arm;

at least one connector having at least one hook portion and a support portion that extends longitudinally forward from the at least one hook portion, wherein the support portion is inserted through the first opening and into the cavity in the support arm, with the support portion including an opening that extends laterally at an angle to the direction of longitudinally forward;

the support arm having a second opening located forward of the proximal end and being aligned with the opening in the support portion of the connector; and at least one locking member inserted into the second opening of the support arm and received by the opening in the support portion of the connector, wherein the at least one hook portion is configured to be inserted into a slot in a vertically disposed standard and the proximal end of the support arm engages the vertically disposed standard when the at least one hook portion is inserted into the slot of the vertically disposed standard.

2. The multi-piece shelf bracket according to claim 1, wherein the connector further comprises a plurality of spaced apart hook portions.

3. The multi-piece shelf bracket according to claim 2, wherein the hook portions are vertically aligned.

4. The multi-piece shelf bracket according to claim 3, wherein the plurality of spaced apart hook portions are configured to be inserted into a plurality of spaced apart slots in a vertically disposed standard.

5. The multi-piece shelf bracket according to claim 1, wherein the at least one locking member fits snugly within the second opening in the support arm.

6. The multi-piece shelf bracket according to claim 1, wherein the at least one connector further comprises two connectors and wherein the respective openings in the support portions of the two connectors are aligned with the second opening in the support arm.

7. The multi-piece shelf bracket according to claim 6, wherein the cavity includes two stop surfaces located forward of the first opening at the proximal end of the support arm.

8. The multi-piece shelf bracket according to claim 7, wherein the support portions of the two connectors include two lugs that are located forward of and engage the respective two stop surfaces in the cavity of the support arm.

9. The multi-piece shelf bracket according to claim 8, wherein the lugs of the support portions of the connectors require the support portions to be partially inserted into the cavity in the support arm while the at least one hook portion is at an acute angle to the proximal end of the support arm and then moved until the at least one hook portion is parallel to the proximal end of the support arm prior to insertion of the at least one locking member into the second opening of the support arm and the openings in the support portions of the connectors.

10. The multi-piece shelf bracket according to claim 1, wherein the second opening in the support arm is through a wall of the support arm.

11. The multi-piece shelf bracket according to claim 10, wherein the wall includes a substantially horizontal surface of the support arm.

12. The multi-piece shelf bracket according to claim 10, wherein the wall includes an upward extending surface of the support arm.

13. The multi-piece shelf bracket according to claim 10, wherein the second opening through a wall is not visible from at least three surfaces of the support arm.

14. The multi-piece shelf bracket according to claim 1, wherein the support portion of the connector includes a lug that is located forward of and engages the stop surface in the cavity of the support arm.

15. The multi-piece shelf bracket according to claim 14, wherein the lug of the support portion of the connector requires the support portion to be partially inserted into the cavity in the support arm while the at least one hook portion is at an angle other than parallel to the proximal end of the support arm and then moved until the at least one hook portion is parallel to the proximal end of the support arm prior to insertion of the at least one locking member into the second opening of the support arm and the opening in the support portion of the connector.

16. The multi-piece shelf bracket according to claim 14, wherein the support portion is configured to be rotated until the at least one hook portion is parallel to the proximal end of the support arm, prior to insertion of the at least one locking member into the second opening of the support arm and the opening in the support portion of the connector.

17. The multi-piece shelf bracket according to claim 16, wherein the support arm further comprises a seating portion that is seated on a seat of the support portion of the connector after the connector is moved into position for insertion of the locking member through the second opening in the support arm and into the opening in the connector.

18. The multi-piece shelf bracket according to claim 1, wherein the support arm is made of a first material and the connector is made of a second material and the first and second materials are different.

19. The multi-piece shelf bracket according to claim 1, wherein the connector is made of a sheet or plate metal material.

20. The multi-piece shelf bracket according to claim 1, wherein the support arm is made of a molded, cast or wooden material.

21. The multi-piece shelf bracket according to claim 1, further in combination with a vertical standard having at least one slot.

22. The multi-piece shelf bracket according to claim 21, wherein the vertical standard further comprises at least one set of spaced apart vertically aligned slots.

23. The multi-piece shelf bracket in combination with the standard according to claim 22, wherein the vertical standard further comprises two sets of spaced apart vertically aligned slots.

24. A method of assembling a multi-piece shelf bracket comprising:

providing a support arm having a first opening at a proximal end and a cavity that extends forward longitudinally into the support arm from the first opening, and a second opening located forward of the proximal end, wherein the cavity includes a stop surface located forward of the first opening at the proximal end of the support arm;

providing at least one connector having at least one hook portion and a support portion that extends longitudinally forward from the at least one hook portion, wherein the support portion including an opening that extends laterally at an angle to the direction of longitudinally forward;

inserting the support portion at least partially into the cavity in the support arm while the at least one hook portion is at an acute angle to the proximal end of the support arm;

moving the connector until the at least one hook portion is parallel to the proximal end of the support arm and the second opening located forward of the proximal end is aligned with the opening in the support portion of the connector; and providing at least one locking member, wherein the at least one locking member is inserted into the second opening of the support arm and received by the opening in the support portion of the connector by inserting the at least one locking member into the second opening of the support arm and the opening in the support portion of the connector; and wherein when assembled the support portion is inserted through the first opening and into the cavity in the support arm, with the support portion including the opening that extends laterally, with the support arm having the second opening located forward of the proximal end and being aligned with the opening in the support portion of the connector, and the at least one locking member is inserted into the second opening of the support arm and received by the opening in the support portion of the connector, wherein the at least one hook portion is configured to be inserted into a slot in a vertically disposed standard and the proximal end of the support arm engages the vertically disposed standard when the at least one hook portion is inserted into the slot of the vertically disposed standard.

25. The method of assembling a multi-piece shelf bracket according to claim 24, wherein the connector further comprises a plurality of spaced apart hook portions.

26. The method of assembling a multi-piece shelf bracket according to claim 24, further comprising a step of locating a lug on the support portion of the connector forward of the stop surface in the cavity of the support arm prior to moving the connector until the at least one hook portion is parallel to the proximal end of the support arm.

27. The method of assembling a multi-piece shelf bracket according to claim 24, further comprising a step of moving the support portion of the connector in a direction parallel to the proximal end of the support arm after being moved until the at least one hook portion is parallel to the proximal end of the support arm and before insertion of the at least one locking member.

28. The method of assembling a multi-piece shelf bracket according to claim 24, further comprising the steps of:

providing two connectors with each connector having a plurality of vertically aligned hook portions and a support portion that extends longitudinally forward from the hook portions, wherein each support portion includes an opening that extends laterally;

inserting the support portions of the two connectors at least partially into the cavity in the support arm while the hook portions are at an acute angle to the proximal end of the support arm;

moving the connectors until the hook portions are parallel to the proximal end of the support arm; and inserting at least one locking member into the second opening of the support arm and the respective openings in the support portions of the connectors.

* * * * *